US012365523B2

(12) United States Patent
McNamara

(10) Patent No.: US 12,365,523 B2
(45) Date of Patent: Jul. 22, 2025

(54) SEAL ARRANGEMENT FOR A CONTAINER CLOSURE

(71) Applicant: Helen of Troy Limited, St. Michael (BB)

(72) Inventor: Conor McNamara, Montclair, NJ (US)

(73) Assignee: KAZ EUROPE SÀRL, Bussigny (CH)

( * ) Notice: Subject to any disclaimer, the term of this patent is extended or adjusted under 35 U.S.C. 154(b) by 21 days.

(21) Appl. No.: 18/029,406

(22) PCT Filed: Sep. 29, 2021

(86) PCT No.: PCT/US2021/052552

§ 371 (c)(1),
(2) Date: Mar. 30, 2023

(87) PCT Pub. No.: WO2022/076218

PCT Pub. Date: Apr. 14, 2022

(65) Prior Publication Data

US 2023/0391517 A1 Dec. 7, 2023

Related U.S. Application Data

(60) Provisional application No. 63/088,045, filed on Oct. 6, 2020.

(51) Int. Cl.
*B65D 53/04* (2006.01)
*B65D 43/02* (2006.01)
(Continued)

(52) U.S. Cl.
CPC ..... *B65D 53/04* (2013.01); *B65D 43/0231* (2013.01); *B65D 47/265* (2013.01);
(Continued)

(58) Field of Classification Search
CPC .. B65D 43/0231; B65D 53/04; B65D 47/265; B65D 47/32; B65D 2205/02;
(Continued)

(56) References Cited

U.S. PATENT DOCUMENTS 8,393,487 B1 3/2013 Pillers
2005/0115977 A1 6/2005 Dibdin
(Continued)

FOREIGN PATENT DOCUMENTS

WO 01-416027 6/2001
WO 2015/094234 6/2015

OTHER PUBLICATIONS

International Search Report for PCT/US/2021/052552, filed Jan. 25, 2022, 2 pages.
European Search Report filed in EP 21878245 dated Sep. 27, 2024.

*Primary Examiner* — Nathan J Jenness
*Assistant Examiner* — Sanjidul Islam
(74) *Attorney, Agent, or Firm* — RANKIN, HILL & CLARK LLP

(57) ABSTRACT

A container closure includes a base member, a cover member and a gasket. The base member is configured for attachment to an associated liquid container and includes abase wall having drinking and venting openings. The cover member is removably connected to the base member and includes a cover wall having drinking and venting apertures in selective registry with the respective drinking and venting openings. The gasket is interposed between the base member and the cover member and has an upper surface facing the cover member. The upper surface integrally defines a first seal member surrounding the drinking aperture and a second seal member surrounding the venting aperture. Each of the first seal member and the second seal member is substantially frustoconical shaped and is adapted to flex outwardly into engagement with the cover member in response to an increase in pressure within the associated container.

19 Claims, 6 Drawing Sheets

(51) Int. Cl.
*B65D 47/26* (2006.01)
*B65D 47/32* (2006.01)

(52) U.S. Cl.
CPC ..... *B65D 47/32* (2013.01); *B65D 2205/02* (2013.01); *B65D 2543/00046* (2013.01); *B65D 2543/00092* (2013.01); *B65D 2543/0024* (2013.01); *B65D 2543/00537* (2013.01)

(58) Field of Classification Search
CPC ..... B65D 2205/01; B65D 2543/00046; B65D 2543/00092; B65D 2543/0025
USPC ..... 220/231, 253
See application file for complete search history.

(56) References Cited

U.S. PATENT DOCUMENTS

2012/0261416 A1* 10/2012 Lin ..... B65D 43/0229 220/253
2013/0082055 A1 4/2013 Ramsey
2013/0240535 A1* 9/2013 Grajqevci ..... B65D 51/22 220/524
2014/0076937 A1* 3/2014 Cavalier ..... B65D 47/265 222/548
2019/0352059 A1 11/2019 Mutch

* cited by examiner

REMOVE CAP

OPEN

VENT

CLOSED

SEAL ARRANGEMENT FOR A CONTAINER CLOSURE

BACKGROUND

Closures or lids for containers help maintain the temperature of a liquid or beverage within the container and also reduce the likelihood of spills of the beverage from the container during use. Many such container closures include a drinking aperture or opening that can be selectively opened and closed. For example, the drink opening can be opened and closed by moving a cover member of the closure with respect to a base member that is attached to the container. Improvements can be made to container closures to reduce the potential of splashing or sputtering of a hot beverage when the closure is opened due to the build-up of steam pressure within the container, to aid in further maintaining the temperature of the beverage within the container, and to aid with the cleanability of the closure.

SUMMARY

According to one aspect, a container closure comprises a base member, a cover member and a gasket. The base member is configured for attachment to an associated liquid container and includes a base wall having drinking and venting openings. The cover member is removably connected to the base member and includes a cover wall having drinking and venting apertures in selective registry with the respective drinking and venting openings. The gasket is interposed between the base member and the cover member and has an upper surface facing the cover member. The upper surface integrally defines a first seal member surrounding the drinking aperture and a second seal member surrounding the venting aperture. Each of the first seal member and the second seal member is substantially frustoconical shaped and is adapted to flex outwardly into engagement with the cover member in response to an increase in pressure within the associated container.

According to another aspect, a container closure comprises a base member, a cover member and a gasket. The base member is configured for attachment to an associated liquid container and includes a base wall having drinking and venting openings. The cover member is removably connected to the base member and includes a cover wall having drinking and venting apertures in selective registry with the respective drinking and venting openings. The gasket is permanently and nonremovably attached to the base member and is interposed between the base member and the cover member. The gasket integrally defines a first seal member surrounding the drinking aperture and a second seal member sized to surround the venting aperture. Each of the first seal member and the second seal member is adapted to flex outwardly into engagement with the cover member in response to an increase in pressure within the associated container.

DETAILED DESCRIPTION

It should, of course, be understood that the description and drawings herein are merely illustrative and that various modifications and changes can be made in the structures disclosed without departing from the present disclosure. For purposes of description herein, spatially relative terms, such as "upper" and "lower" and the like, may be used to describe an element and/or feature's relationship to another element (s) and/or feature(s) as, for example, illustrated in the figures of the present disclosure.

Figure 1:
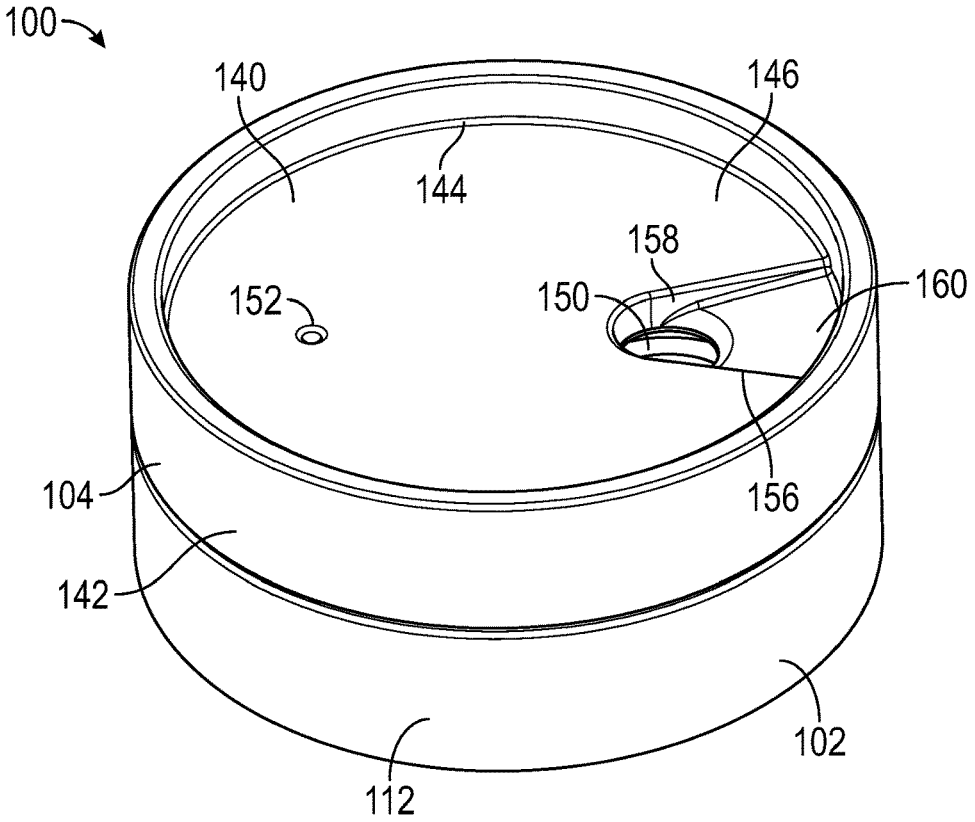
FIG. 1 is a top perspective view of a container closure according to the present disclosure, the closure including a base member, a cover member and a seal arrangement.
Figure 2:
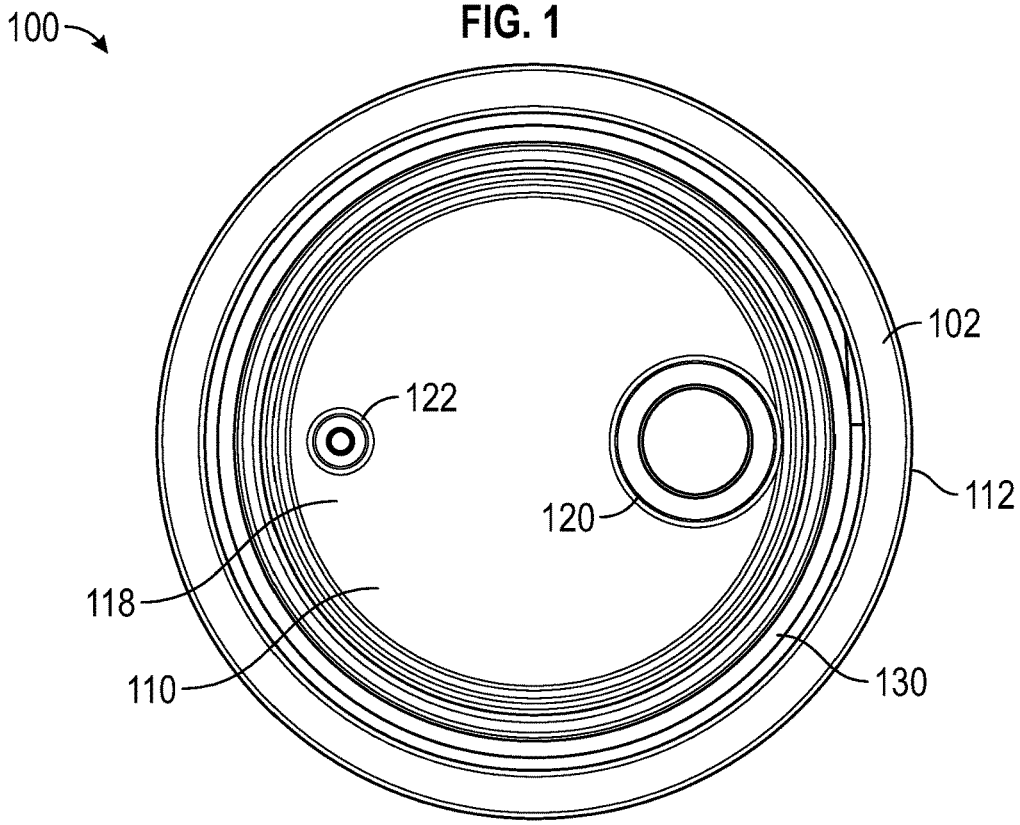
FIG. 2 is a bottom plan view of the container closure of FIG. 1.
Figure 3:
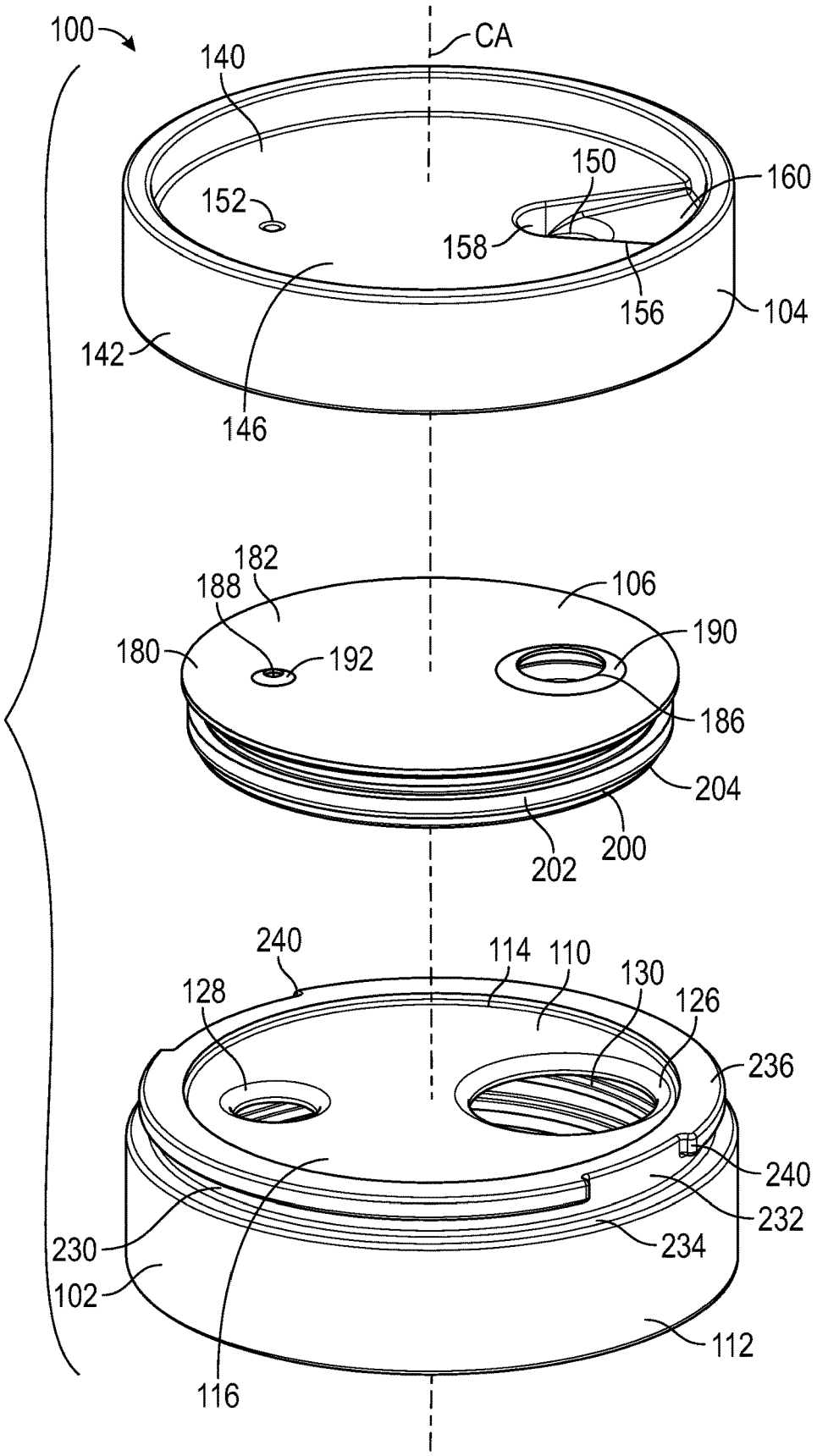
FIGS. 3 and 4 are exploded perspective views of the exemplary container closure, noting that the seal arrangement is detached from the base member for clarity of the features of the closure.

Referring now to the drawings, wherein like numerals refer to like parts throughout the several views, FIG. 1-4 illustrate an exemplary closure 100 for an associated liquid or beverage container (not shown) according to the present disclosure. The container closure 100 (which may alternatively be referred to as a cap or lid) generally comprises a base member 102, a cover member 104, and a seal arrangement 106. The base member 102 is configured for attachment to the associated liquid container and includes a base wall having drinking and venting openings. The base member 102 includes a base wall 110 and a sidewall 112 extending downward about a peripheral edge portion 114 of the base wall. The base wall 110 includes an upper surface 116 and a lower surface 118 with a drinking opening 120 and a smaller venting opening 122 extending through the base wall. The center of the drinking opening 120 can be offset approximately 180° from the center of the venting opening 122 relative to a longitudinal axis CA of the closure 100; although, this is not required. In FIG. 3, first and second upper surface portions 126, 128 of the base wall 110 that at least partially define the respective drinking and venting openings 120, 122 are chamfered or flared outwardly relative to the center of each drinking and venting opening 120, 122; although, this is not required.

An inner surface of the sidewall 112 includes a first securing element (i.e., a first threading 130) that is complementary to a second securing element (i.e., a second threading) typically disposed on a corresponding neck portion of the associated container. That is, the first threading may be configured to mate with the second threading, so that the closure 100 may be secured to the neck portion and thereby secured to and against a mouth of the associated container. It should be appreciated that additional and/or alternative configurations of securing elements may be used to secure the closure 100 against the associated container, for example, a snap-fit or crimped rim. In such cases the closure 100 and corresponding neck portion of the associated container need not be circular.

It should be appreciated that the associated container can be any known container configured to retain a desired liquid or beverage at a temperature that can be either higher or lower than an ambient temperature. For example, the container can be a beverage container, and may correspond to or resemble a bottle, jug, growler, vessel, carafe, or similar beverage container. The container may be fashioned from any material having the desired properties for a beverage container, such as a stainless steel or a plastic formulation (e.g., a thermoplastic, or a thermosetting polymer). In addition, the container may incorporate a double-walled construction, with the intervening space between the walls being substantially evacuated, so that the container is a vacuum-insulated container. Examples of appropriate containers for use with the closure 100 are those commercially available from HYDRO FLASK (Bend, Oregon).

With reference to FIGS. 1-4, the cover member 104, which is removably connected to the base member 102, includes a cover wall 140 and a sidewall 142 extending both upward and downward about a peripheral edge portion 144 of the cover wall. The cover wall 140 includes an upper surface 146 and a lower surface 148 with a drinking aperture 150 and a smaller venting aperture 152 extending through the cover wall 140. The drinking and venting apertures 150, 152 are in selective registry/alignment with the respective drinking and venting openings 120, 122 depending on a position of the cover member 104 with respect to the base member 102. More particularly, according to the present disclosure the cover member 104 is adapted to move relative to the base member 102 between a closed position wherein the drinking and venting apertures 150, 152 are out of registry/alignment with the respective drinking and venting openings 120, 122, an optional vent position to be described in greater detail below, and an open position wherein the drinking and venting apertures 150, 152 are in registry/alignment with the respective drinking and venting openings 120, 122. The sidewall 142 of the cover member 104 may further include a grippable and/or manipulable surface configured to assist in moving the cover member 104 and attaching and/or detaching the cover member 104 to/from the base member 102.

Figure 5:
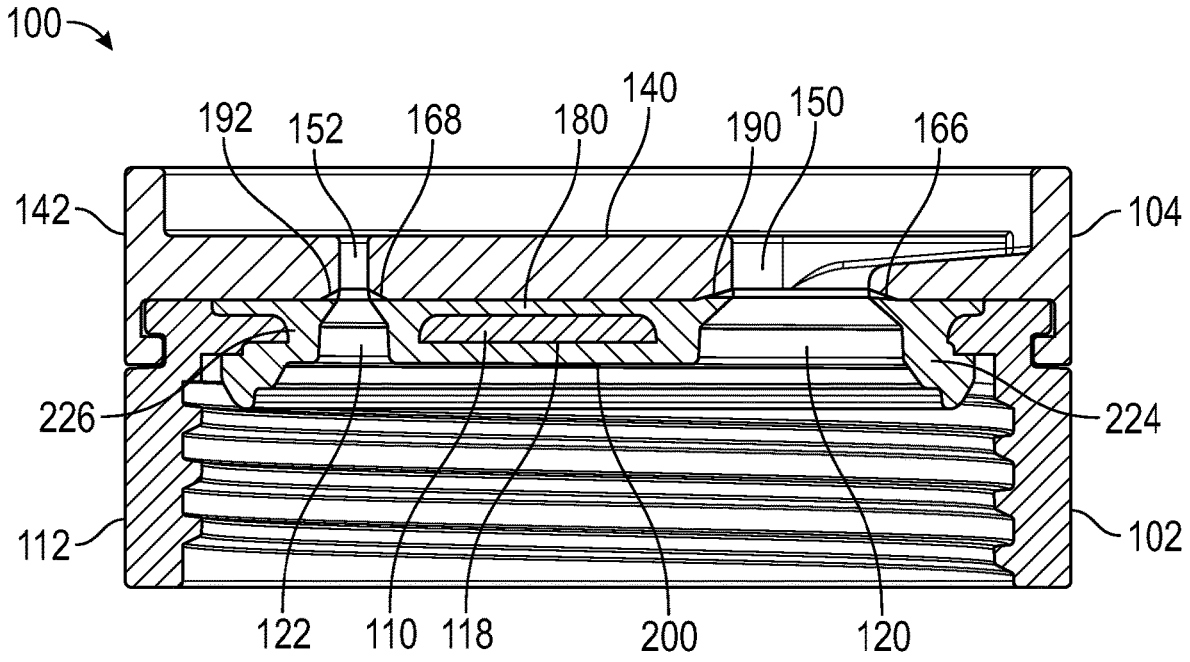
FIGS. 5 and 6 are cross-sectional views of the closure of FIG. 1.

A liquid or beverage channel 156 is defined in the upper surface 146 of the cover wall 140, and the channel 156 is in fluid communication with the drinking aperture 150. As depicted, the channel 156 includes a generally U-shaped channel sidewall 158 that extends from the sidewall 142 around the drinking aperture 150 and a channel bottom wall 160 that extends from the sidewall 158 downward toward the drinking aperture 150. In FIG. 5, first and second lower surface portions 166, 168 of the lower surface 148 of the cover wall 140 that at least partially define the respective drinking and venting apertures 150, 152 are chamfered or flared outwardly relative to the center of each drinking and venting aperture.

Figure 4:
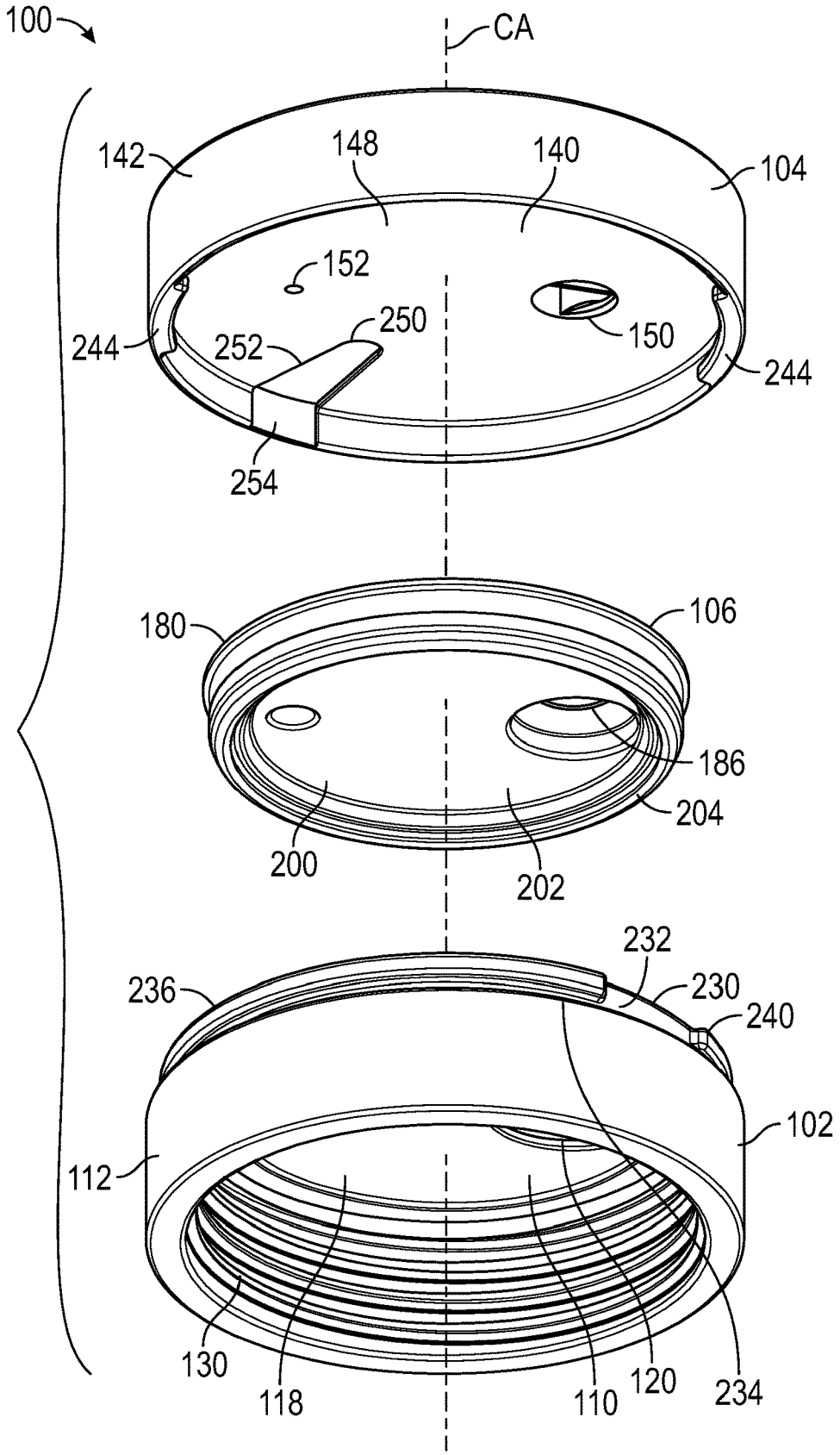
Figure 6:
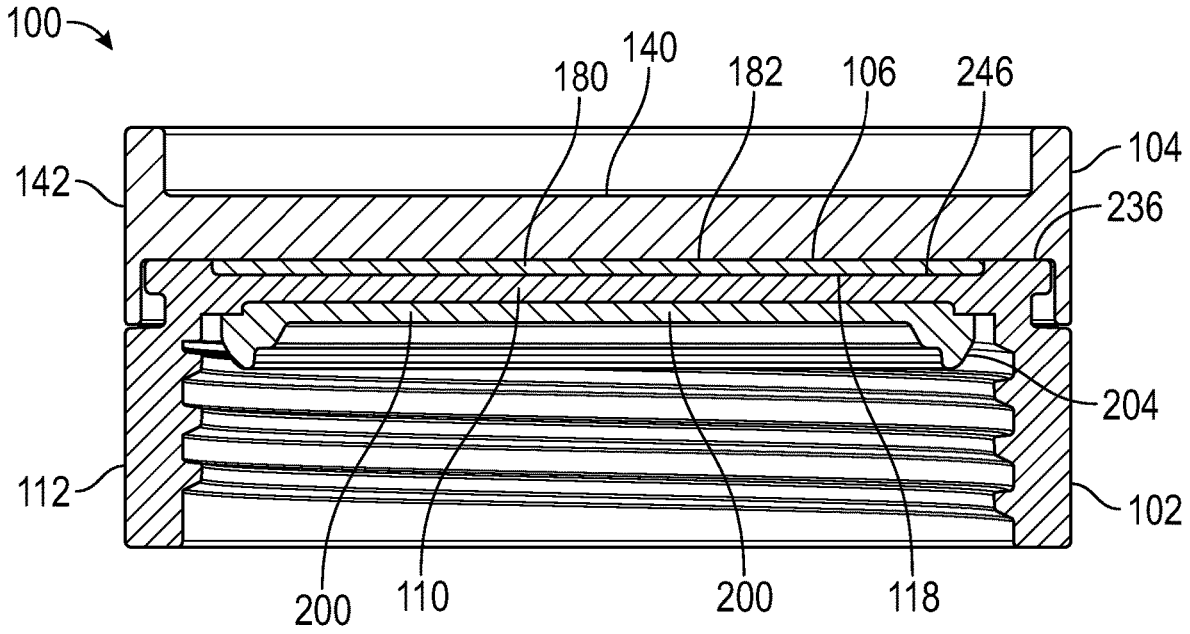
Figure 7:
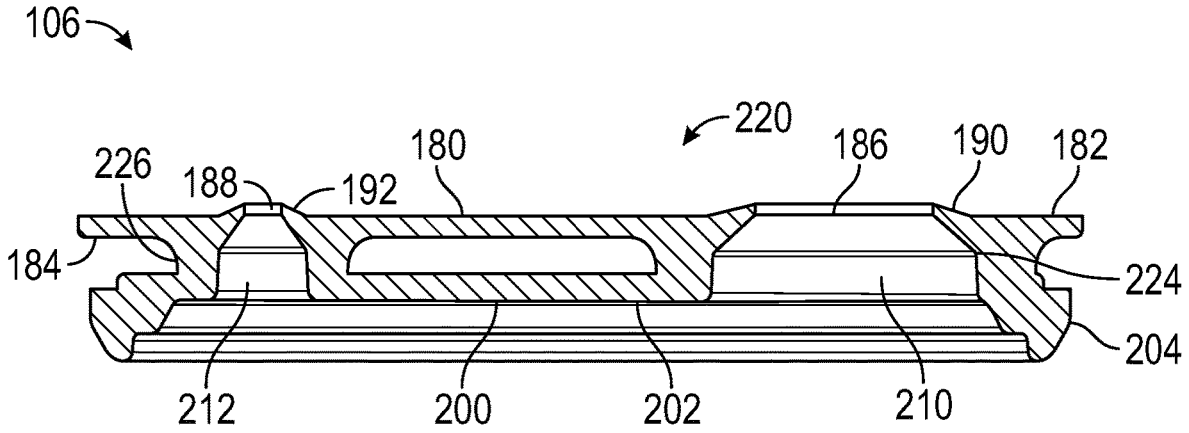
FIGS. 7 and 8 are cross-sectional views of the seal arrangement.
Figure 8:
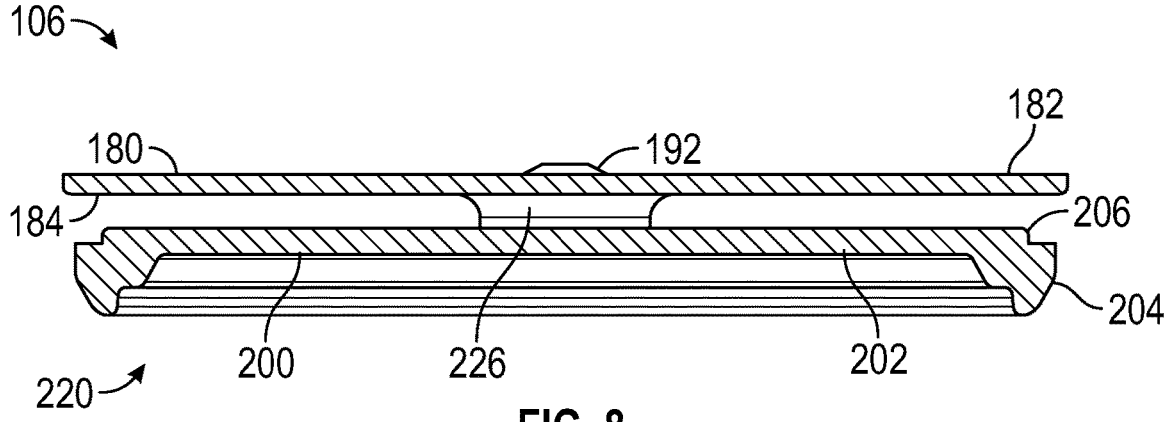

The seal arrangement 106 of the present disclosure includes a gasket 180 attached to the base member 102 and interposed between the base member 102 and the cover member 104. According to one aspect, the gasket 180 is permanently and nonremovably attached to the base member 102 (see FIGS. 5 and 6), therefore, it should be appreciated that the exploded views of FIGS. 3 and 4 depicting the gasket separated from the base member 102 are provided to better show the features of the closure 100. With reference to FIGS. 7 and 8, the gasket 180 includes an upper surface 182, a lower surface 184, and drinking and venting first through holes 186, 188. The drinking and venting first through holes 186, 188 are in constant fluid communication with the drinking and venting openings 120, 122 of the base member 102 and in selective fluid communication with the drinking and venting apertures 150, 152 of the cover member 104 depending on the position of the cover member 104 relative to the base member 102. The upper surface 182 facing the cover member 104 integrally defines a first seal member 190 surrounding the drinking first through hole 186 and a separate second seal member 192 surrounding the venting first through hole 188. In the open position of the cover member 104, the first seal member 190 sealingly engages the lower surface 148 of the cover wall 140 surrounding the drinking aperture 150, and the second seal member 192 sealingly engages the lower surface 148 or the cover wall 140 surrounding the venting aperture 152. Each of the first seal member 190 and the second seal member 192 is tapered in cross-section (see FIG. 7) and extends upwardly and inwardly from the upper surface 182 so as to have a substantially frustoconical shape. Further, the first and second seal members 190, 192 are adapted to flex outwardly into engagement with the lower surface 148 of the cover member 104, particularly the respective first and second lower surface portions 166, 168 of the lower surface 148, in response to an increase in pressure within the associated container.

In FIGS. 7 and 8, the seal arrangement 106 additionally includes a container seal 200, which according to the present disclosure, is permanently and nonremovably attached to the base member 102. The container seal 200 includes a seal base 202 and a seal sidewall 204 extending downward from a peripheral edge portion 206 of the seal base 202. The seal base 202 sealingly engages the inner lower surface 118 of the base wall 110 (see FIGS. 5 and 6), and includes drinking and venting second through holes 210, 212 in fluid communication with the drinking and venting first through holes 186, 188 of the gasket 180. Therefore, the drinking and venting second through holes 210, 212 are in constant fluid communication with the drinking and venting openings 120, 122 of the base member 102, and in the open position of the cover member 104, the drinking and venting second through holes 210, 212 are in fluid communication with the drinking and venting apertures 150, 152 of the cover member 104. In the depicted aspect, the gasket 180 and the container seal 200 are integrally formed to define a unitary sealing component 220 for the seal arrangement 106, and because the seal sidewall 204 is adapted to sealingly engage the associated container, there is no need for a separate seal as is common in the art. The sealing component 220 integrally includes first and second separate fluid conduits 224, 226 that separate the gasket 180 and the container seal 200. The first fluid conduit 224 extended between the drinking first and second through holes 186, 210 (and therefore through the drinking opening 120 of the base member 102) fluidly connects the drinking opening 120 and the drinking aperture 150 in the open position of the cover member 104. The separate second fluid conduit 226 extended between the venting first and second through holes 188, 212 (and therefore through the venting opening 122 of the base member 102) fluidly connects the venting opening 122 and the venting aperture 150 in the open position of the cover member 104. To permanently and nonremovably attach the sealing component 220 to the base member 102, the sealing component can be overmolded onto the base wall 110 of the base member 102.

Figure 9:
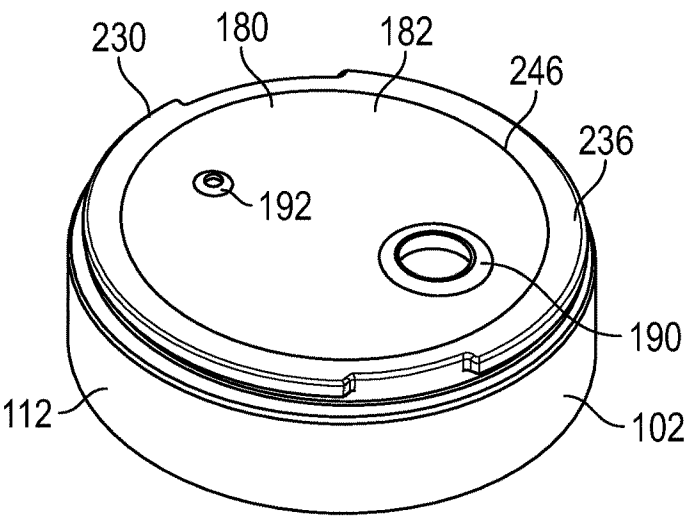
FIG. 9 is a top perspective view of the container closure sans the cover member.
Figure 14:
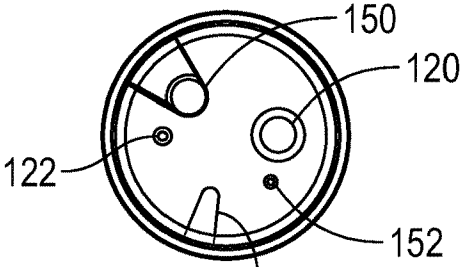
FIGS. 11, 12, 13 and 14 are bottom plan views of the container closure in respective closed, vent, open, and remove/detach positions.
Figure 13:
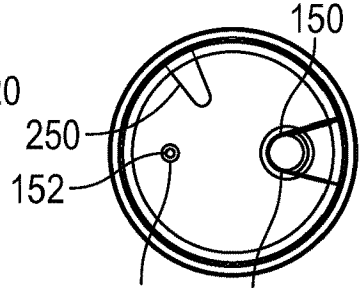
Figure 12:
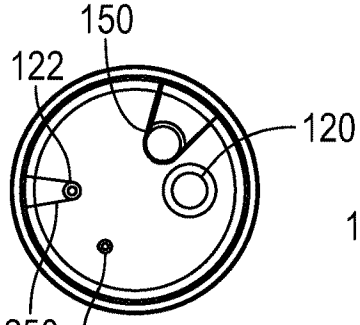

As indicated previously, the cover member 104 is adapted to move relative to the base member 102 between the closed position, optional vent position, and the open position. To this end, in FIGS. 3 and 4, the base member 102 defines a guide track 230 extended about a circumference of the peripheral edge portion 114 of the base wall 110. The guide track 230 is defined by a track sidewall 232 offset inwardly from the sidewall 112, an upper wall 234 of the sidewall 112, and an upper flange wall 236 extending outward of the track sidewall 232. A pair of notches 240 are formed in the upper flange wall 236, the notches can be diametrically spaced relative the longitudinal axis CA. The sidewall 142 of the cover member 104 includes a pair of inwardly extending ledges 244. The ledges 244 are sized to be received by the notches 240 and for movable receipt in the guide track 230. In FIGS. 6 and 9, the track sidewall 232 together with the base wall 110 define a recessed floor region 246. The gasket 180 is received in the floor region 246, with the upper surface 182 of the gasket 180 substantially flush with an upper surface of the upper flange wall 236.

Figure 10:
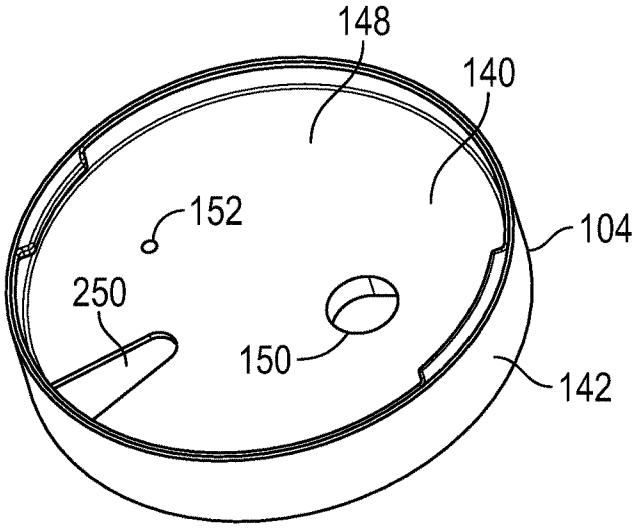
FIG. 10 is a bottom perspective view of the cover member.

To provide for the optional vent position of the cover member 104 relative to the base member 102, the cover member includes a vent channel 250 separate from the drinking and venting apertures 150, 152 (see FIGS. 4 and 10). The vent channel 250 is positioned between the drinking and venting apertures 150, 152, and is closer to the venting aperture 152, which is partly due to the size difference between the drinking and venting apertures 150, 152. As shown, the vent channel 250 is formed on the lower surface 148 of the cover wall 140 and extends onto an inner surface of the sidewall 142. Specifically, the vent channel 250 includes a generally U-shaped surface channel portion 252 formed on the lower surface 148 that extends toward the sidewall 142, and a sidewall channel portion 254 formed on the sidewall 142 that extends from the surface channel portion 252 to a lower edge of the sidewall 142. In the vent position, the drinking aperture 150 is out of registry with the drinking opening 120, and the vent channel 250 is in fluid communication with the venting aperture 152 allowing pressure and steam to escape between the cover member 104 and the base member 102.

Figure 11:
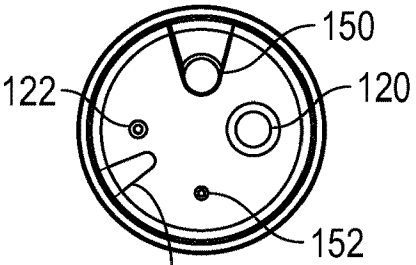

FIGS. 11-14 depict the positions of the cover member 104 with respect to the base member 102. In FIG. 11, the cover member 104 is in the closed position with the drinking and venting apertures 150, 152 of the cover member 104 out of registry/alignment with the drinking and venting openings 120, 122 of the base member 102. In the closed position, the first and second seal members 190, 192 of the gasket 180 seal against the lower surface 148 of the cover wall 140 to close the drinking and venting openings 120, 122 of the base member 102. The cover member 104 is adapted to move (i.e., rotate about the longitudinal axis CA) in a single, first direction relative to the base member 102 from the closed position to the vent position of FIG. 12. Again, in the vent position only the vent channel 250 is in fluid communication with the venting opening 122. The first seal member 190 continues to seal against the lower surface 148 to close the drinking opening 120. The cover member 104 is adapted to again move in the first direction relative to the base member 102 from the vent position toward the open position of FIG. 13. In the open position, the drinking and venting apertures 150, 152 are in registry/alignment with the respective drinking and venting openings 120, 122, with the first and second seal members 190, 192 sealingly engaged with the first and second lower surface portions 166, 168 of the cover wall 140 that at least partially define the respective drinking and venting apertures 150, 152. The cover member 104 is adapted to further move in the first direction from the open position toward a remove/detach position of FIG. 14. In this remove/detach position, the ledges 244 of the cover member 104 are aligned with the notches 240 of the base member 102 so that each ledge moves through a respective notch when moving the cover member away from the base member. This allows the cover member 104 to be removable from the base member 102 by moving the cover member with respect to the base member in a direction parallel with the longitudinal axis CA.

It will be appreciated that the above-disclosed embodiments and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A container closure, comprising:

a base member configured for attachment to an associated liquid container, the base member including a base wall having drinking and venting openings;

a cover member removably connected to the base member, the cover member including a cover wall having drinking and venting apertures in selective registry with the respective drinking and venting openings; and a gasket interposed between the base member and the cover member and having an upper surface facing the cover member, the upper surface of the gasket integrally defines a first seal member surrounding the drinking aperture and a second seal member surrounding the venting aperture, each of the first seal member and the second seal member is substantially frustoconical shaped and is adapted to flex outwardly into engagement with the cover member in response to an increase in pressure within the associated container, wherein the base member includes a wall having a guide track extended about a circumference of the base wall, the wall and an upper surface of the base wall defining a floor region sized to receive the gasket, and the cover member includes an inwardly extending ledge sized for movable receipt in the guide track, the cover member adapted to rotate with respect to the base member via the ledge received in the guide track, further including a container seal secured to the base member, the container seal including a seal base and a seal sidewall extending downward from a peripheral edge portion of the seal base, the seal base adapted to sealingly engage an inner surface of the base wall, the seal sidewall adapted to sealingly engage the associated container.

2. The container closure of claim 1, wherein the gasket is permanently and nonremovably attached to the base member.

3. The container closure of claim 1, wherein the gasket is connected to the container seal via a first fluid conduit and a separate second fluid conduit, the first fluid conduit fluidly connects the drinking aperture and the drinking opening and the second fluid conduit fluidly connects the venting aperture and the venting opening.

4. The container closure of claim 3, wherein the gasket, the container seal, and the first and second fluid conduits are integrally formed to define a unitary sealing component.

5. The container closure of claim 4, wherein the sealing component is overmolded onto the base member so as to be permanently and nonremovably attached to the base member.

6. A container closure, comprising:

a base member configured for attachment to an associated liquid container, the base member including a base wall having drinking and venting openings;

a cover member removably connected to the base member, the cover member including a cover wall having drinking and venting apertures in selective registry with the respective drinking and venting openings;

a gasket permanently and nonremovably attached to the base member and interposed between the base member and the cover member, the gasket integrally defines a first seal member surrounding the drinking aperture and a second seal member sized to surround the venting aperture, each of the first seal member and the second seal member is adapted to flex outwardly into engagement with the cover member in response to an increase in pressure within the associated container.

7. The container closure of claim 6, wherein a container seal is permanently and nonremovably attached to the base member and adapted to sealingly engage the associated container.

8. The container closure of claim 7, wherein the gasket and the container seal are integrally formed to define a unitary sealing component.

9. The container closure of claim 8, wherein the sealing component integrally includes first and second fluid conduits separating the gasket and the container seal, the first fluid conduit fluidly connecting the drinking aperture and the drinking opening and the second fluid conduit fluidly connecting the venting aperture and the venting opening.

10. The container closure of claim 6, wherein the cover member includes a vent channel separate from the drinking and venting apertures, the vent channel adapted to allow pressure and steam to escape between the cover member and the base member.

11. The container closure of claim 10, wherein the cover member is adapted to move in a single direction relative to the base member from a closed position wherein the drinking and venting apertures are out of registry with the respective drinking and venting openings toward a vent position wherein only the vent channel is in fluid communication with the venting opening, and from the vent position toward an open position wherein the drinking and venting apertures are in registry with the respective drinking and venting openings.

12. The container closure of claim 11, wherein the cover member is adapted to further move in the single direction from the open position toward an detach position in which the cover member is removable from the base member.

13. A container closure, comprising:

a base member configured for attachment to an associated liquid container, the base member including a base wall having a drinking opening and a venting opening;

a cover member removably connected to the base member, the cover member including a cover wall having a drinking aperture and a venting aperture in selective registry with the respective drinking opening and venting opening; and a gasket interposed between the base member and the cover member and having an upper surface facing the cover member, the upper surface integrally defines a seal member surrounding the drinking aperture, wherein the cover member includes a vent channel separate from the drinking and venting apertures, the vent channel adapted to allow pressure and steam to escape between the cover member and the base member, wherein the cover member is adapted to move relative to the base member between a closed position wherein the drinking and venting apertures are out of registry with the respective drinking and venting openings, a vent position wherein only the vent channel is in fluid communication with the venting opening and the drinking aperture is out of registry with the drinking opening, and an open position wherein the drinking and venting apertures are in registry with the respective drinking and venting openings.

14. The container closure of claim 13, wherein the base member includes a wall having a guide track, the wall and the base wall defining a floor region sized to receive the gasket, and the cover member includes a ledge sized for movable receipt in the guide track, the cover member adapted to rotate with respect to the base member via the ledge received in the guide track.

15. The container closure of claim 13, wherein the cover member is adapted to rotate about a longitudinal axis of the closure with respect to the base member, the cover member rotates in a first direction from the closed position toward the vent position, rotates in the first direction from the vent position toward the open position, and the cover member rotates in the first direction from the open position toward a detach position in which the cover member is removable from the base member by moving the cover member with respect to the base member in a direction parallel with the longitudinal axis.

16. The container closure of claim 13, wherein the upper surface of the gasket integrally defines a second seal member surrounding the venting aperture.

17. The container closure of claim 13, further including a container seal secured to the base member, the container seal including a seal base and a seal sidewall extending downward from a peripheral edge portion of the seal base, the seal base adapted to sealingly engage an inner surface of the base wall, the seal sidewall adapted to sealingly engage the associated container.

18. The container closure of claim 17, wherein the gasket is connected to the container seal via a first fluid conduit and a separate second fluid conduit, the first fluid conduit fluidly connects the drinking aperture and the drinking opening and the second fluid conduit fluidly connects the venting aperture and the venting opening.

19. The container closure of claim 18, wherein the gasket, the container seal, and the first and second fluid conduits are integrally formed to define a unitary sealing component.

* * * * *